United States Patent [19]

Hishinuma et al.

[11] Patent Number: 4,671,239

[45] Date of Patent: Jun. 9, 1987

[54] FUEL INJECTION PUMP

[75] Inventors: Osamu Hishinuma, Kariya; Akira Masuda, Aichi; Toshihiko Ohmori, Nagoya; Masahiko Miyaki; Eiji Takemoto, both of Obu, all of Japan

[73] Assignee: Nippondenso Co., Ltd., Kariya, Japan

[21] Appl. No.: 755,651

[22] Filed: Jul. 16, 1985

[30] Foreign Application Priority Data

Jul. 17, 1984 [JP] Japan ..... 59-149094
Jul. 20, 1984 [JP] Japan ..... 59-151796

[51] Int. Cl.[4] ..... F02M 39/00

[52] U.S. Cl. ..... 123/458; 123/450; 417/462

[58] Field of Search ..... 123/458, 450, 500, 501, 123/503; 417/462

[56] References Cited

U.S. PATENT DOCUMENTS

| | | | |
|---|---|---|---|
| 4,367,715 | 1/1983 | Watson | 123/458 |
| 4,445,822 | 5/1984 | Hoshi | 123/450 |
| 4,453,896 | 6/1984 | Vilardo | 417/462 |
| 4,488,526 | 12/1984 | Takahashi | 123/450 |
| 4,492,200 | 1/1985 | Takahashi | 123/450 |
| 4,492,534 | 1/1985 | Miyaki | 123/450 |
| 4,550,702 | 11/1985 | Djordjeuic | 123/450 |
| 4,572,138 | 2/1986 | Mowbray | 123/450 |
| 4,574,759 | 3/1986 | Leblanc | 123/450 |

FOREIGN PATENT DOCUMENTS

| | | |
|---|---|---|
| 57-56660 | 4/1982 | Japan . |
| 57-124068 | 8/1982 | Japan . |

*Primary Examiner*—Carl Stuart Miller
*Attorney, Agent, or Firm*—Cushman, Darby & Cushman

[57] ABSTRACT

A fuel injection pump for an internal combustion engine has a shaft rotatable by the engine. The shaft is formed therein with a radial bore and an axial bore communicated therewith. Pumping plungers are slidably disposed in the radial bore to cooperate therewith to define a compression chamber and cyclically reciprocated to vary the volume of the compression chamber. An injection plunger is slidably disposed in the axial bore to divide the interior thereof into a first pressure chamber always communicated with the compression chamber and a second pressure chamber adapted to be communicated with a delivery port in a discharge stroke of the pump. The first and second pressure chambers are supplied with fuel in a suction stroke of the pump. The fuel in the second pressure chamber is discharged therefrom in the discharge stroke. A single solenoid valve is provided to control the fuel discharge timing and the quantity of fuel to be discharged from the pump.

8 Claims, 13 Drawing Figures

FUEL INJECTION PUMP

FIELD OF THE INVENTION

The present invention relates to a fuel injection pump for internal combustion engines and, more particularly, to a fuel injection pump in which the fuel injection timing and the quantity of fuel to be injected can preferably be controlled by an electronic control system.

DECRIPTION OF THE PRIOR ART

Japanese Un-Examined Patent Publication No. 57-56660 laid-open Apr. 5, 1982 discloses a fuel injection pump having a rotatable shaft in which a radial bore is formed and receives a pair of pumping plungers cooperating with the bore to define a compression chamber and adapted to be cyclically reciprocated to vary the volume of the compression chamber during operation of the pump. The shaft is also formed therein with an axial bore communicated with the compression chamber and slidably receiving an injection plunger which divides the interior of the axial bore into two pressure chambers one of which is communicated with the compression chamber and the other of which is adapted to be communicated with a delivery port of the pump. One of the two compression chambers is supplied with a quantity of fuel related to the amount of fuel to be injected, while the other chamber is supplied with another quantity of fuel related to the fuel injection timing of the pump. The fuel supplies to the two pressure chambers are controlled by two valve means, respectively. When the pump is in its discharge stroke, the pumping plungers are radially inwardly moved to vary the volume of the compression chamber to displace the fuel therein into the one pressure chamber so that the injection plunger is forcibly moved toward the other chamber whereby the fuel therein is discharged therefrom and out of the pump. The prior art pump has a disadvantage that the pump structure is complicated and expensive. This is because two valve means are required for the control of the fuel supplies into the two pressure chambers.

SUMMARY OF THE INVENTION

The present invention has its object to provide an improved fuel injection pump for internal combustion engines which has a simplified structure and is inexpensive and which can be controlled by an electronic control system.

The fuel injection pump according to the present invention includes means defining a compression chamber of a volume which is cyclically varied when the pump is operated. The compression chamber volume is maximum at the end of a suction stroke of the pump and is minimum at the end of a discharge stroke thereof. A bore is provided in communication with the compression chamber. An injection plunger is slidably disposed in the bore to cooperate therewith to define first and second pressure chambers separated from one another by the injection plunger. The first pressure chamber is always communicated with the compression chamber. The first and second pressure chambers have volumes variable as the injection plunger is slidably moved in the bore. The pump further includes first passage means adapted to be communicated selectively with the first and second pressure chambers. The first and second pressure chambers are supplied with fuel in the suction stroke of the pump. The compression chamber is operative to suck the fuel from the first pressure chamber in the suction stroke and pump the fuel into the first pressure chamber in the discharge stroke to forcibly displace the injection plunger toward the second pressure chamber so that the fuel in the second pressure chamber is discharged therefrom through second passage means provided in the pump. A single valve means is disposed in the first passage means and has two operative positions in one of which the first passage means is opened and in the other of which the first passage means is closed. The valve operation is adapted to be controlled to control the fuel discharge timing of the pump and the quantity of fuel to be discharged from the pump in each discharge stroke thereof.

The above and other objects, features and advantages of the present invention will be made more apparent by the following description with reference to the accompanying drawings.

BRIEF DESCRIPTION OF THE DRAWINGS

FIGS. 1 to 5 illustrate a first embodiment of the fuel injection pump according to the present invention, wherein:

FIG. 1 is an axial sectional view of the fuel injection pump when in a fuel suction stroke;

FIG. 2 is a similar view of the fuel injection pump when in a fuel discharge stroke;

FIG. 3 is an axial sectional view of the pump taken along line III—III in FIG. 2;

FIG. 4 is a cross-sectional view of the pump taken along line IV—IV in FIG. 2; and FIG. 5 graphically illustrates the operation characteristics of the fuel injection pump in respect of reference signals, cam lift and operative positions of an electromagnetic valve all relative to cam angle;

FIGS. 6 to 10 illustrate a second embodiment of the fuel injection pump according to the present invention, wherein:

FIG. 6 is an axial sectional view of the fuel injection pump when in a suction stroke;

FIG. 7 is an axial sectional view of the pump when in a discharge stroke;

FIG. 8 is an axial sectional view of the pump taken along line VIII—VIII in FIG. 7;

FIG. 9 is a fragmentary side view of a shaft; and

FIG. 10 is similar to FIG. 5 but graphically illustrates the operation characteristics of the second embodiment of the invention;

FIGS. 11–13 illustrate a third embodiment of the fuel injection pump according to the present invention, wherein;

FIG. 11 is an axial sectional view of the pump when in a suction stroke;

FIG. 12 is an axial sectional view of the pump when in a discharge stroke; and FIG. 13 is similar to FIGS. 5 and 10 but graphically illustrates the operation characteristics of the third embodiment of the invention.

DESCRIPTION OF THE PREFERRED EMBODIMENTS

Figure 1:
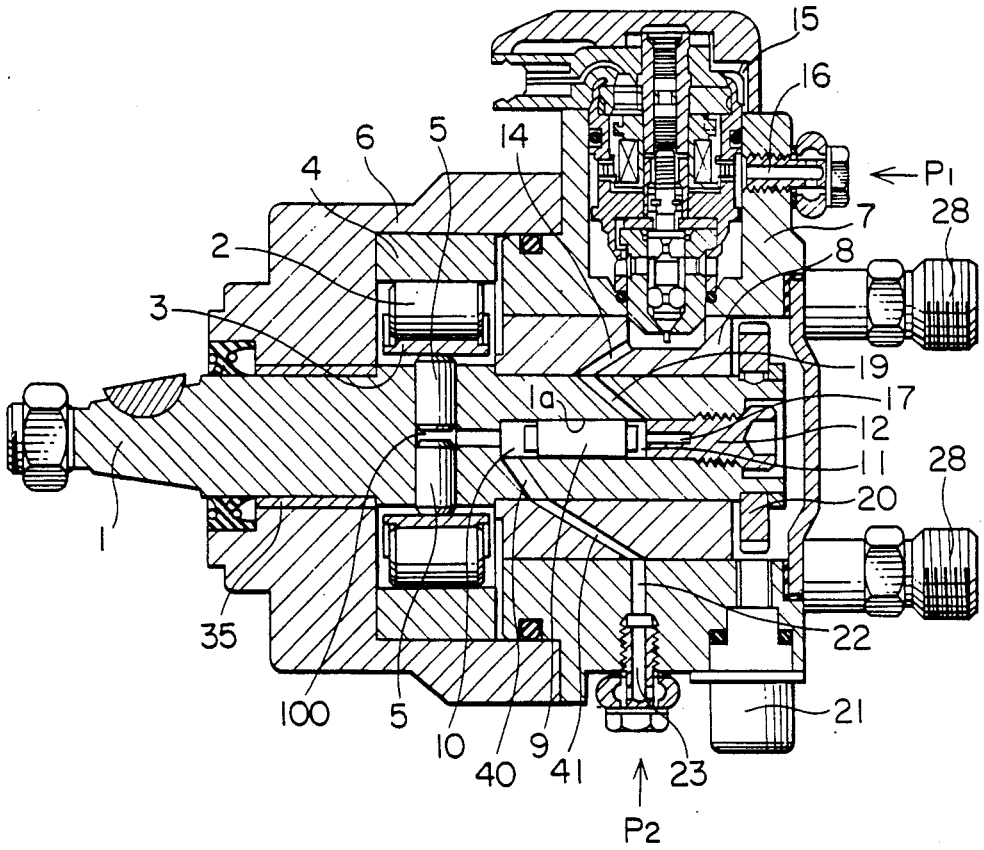

Referring to FIGS. 1 to 4, a shaft 1 is adapted to be rotated in synchronism with the operation of an internal combustion engine (not shown) and carries a pair of pumping plungers 5 both slidably received in a diametrical bore formed in the shaft. The opposed inner ends of the plungers 5 define a compression chamber 100 therebetween. A roller shoe 3 and a roller 2 are associated with the outer end of each plunger 5. The plungers 5, the shoes 3 and the rollers 2 are adapted to be rotated with the shaft 1 about the axis thereof.

Figure 4:
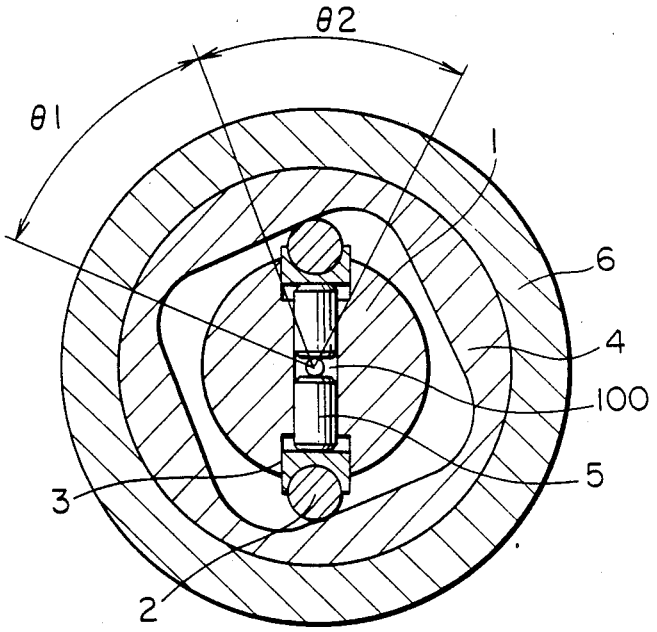

As will be seen in FIG. 4, the rollers 2 are in rolling engagement with an inner cam surface of a roller ring 4 which is mounted in a generally cup-shaped first housing member 6. The shaft 1 is rotatably supported by a bearing 35 fitted into a bore in the first housing member 6 and by a third housing 8 mounted in a second housing member 7 secured to the first housing member 6.

The shaft 1 is formed therein with an axial bore 1*a* having an end communicated with the compression chamber 100. The other end of the bore 1*a* is closed by a plug 12 sealingly screwed into the other end of the bore 1*a*. An injection plunger 9 is slidably disposed in the axial bore 1*a* to divide the interior thereof into two spaces, one being a first pressure chamber 10 communicated with the compression chamber 100 and the other being a second pressure chamber 11 adjacent to the plug 12. The first pressure chamber 10 is communicated with generally radial suction fuel passages 40 formed in the shaft 1. The suction fuel passages 40 are the same in number as the engine cylinders and, when the shaft 1 is rotated, adapted to be successively brought into communication with a passage 41 formed in the third housing 8, the passage 41 being communicated with aligned radial passages 22 and 23 formed in the housing member 7. When the passage 41 is communicated with one of the suction passages 40, the pump is in a suction stroke.

Figure 2:
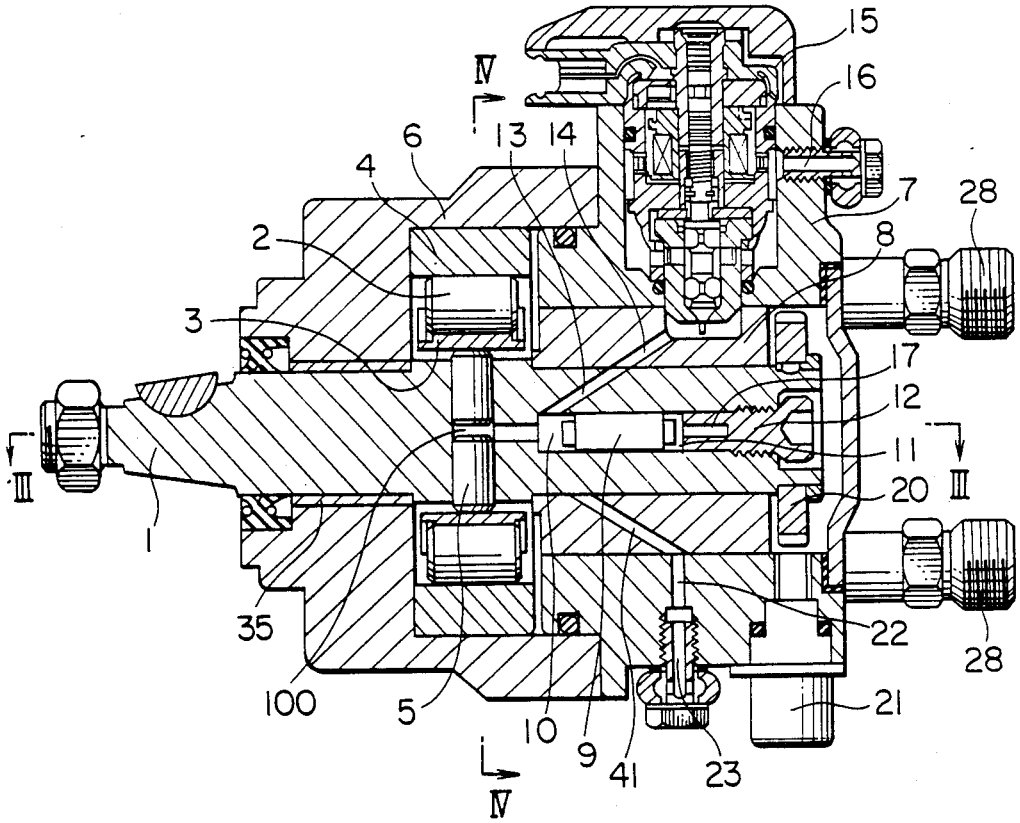

Referring to FIG. 2, the pressure chamber 10 is also communicated with generally radial control passages 13 formed in the shaft 1, the passages 13 being the same in number as the engine cylinders. When the shaft 1 is rotated, the control passages 13 are successively brought into communication with a fuel passage 14 formed in the third housing 8. When the passage 14 is communicated with one of the control passages 13, the pump is in a discharge stroke.

With reference again to FIG. 1, the second compression chamber 11 is communicated with suction fuel passages 19 formed in the shaft 1 and being of the same in number as the engine cylinders. When the shaft 1 is rotated, the suction passages 19 are successively brought into communication with the fuel passage 14 in the third housing 8. When one of the suction passages 19 is in communication with the fuel passage 14, the pump is in a suction stroke.

Figure 3:
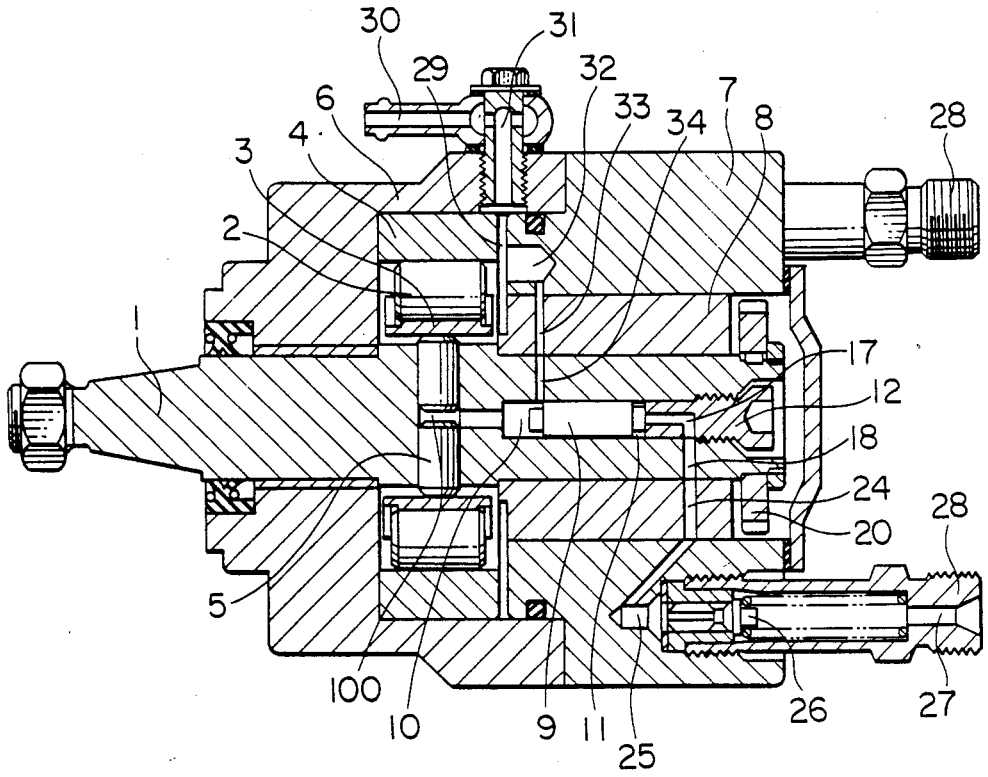

Referring to FIG. 3, the second pressure chamber 11 is communicated with a passage 17 in the plug 12 and with a discharge fuel passage 18 formed in the shaft 1. In a discharge stroke of the pump, the passage 18 is communicated with one of radial passages 24 which in turn are respectively communicated with passages 25 formed in the housing member 7. The passages 25 are each communicated with a delivery port 27 formed in a valve holder 28 which is secured to the housing member 7 with a sucking-back valve 26 disposed in the port 27. The valve holder 28 is also adapted to be connected with a delivery conduit, not shown. There are a plurality of such valve holders 28.

The shaft 1 is further formed therein with radial spill holes 34 and one of the spill holes 34 adapted to be communicated with the first pressure chamber 10 just before or when the injection plunger 9 is brought into contact with the plug 12. The spill hole 34 is adapted to be brought into communication with a radial passage 33 in the bushing 8, with a passage 32 and with a chamber 29 both in the housing member 7, with a passage 31 in the housing member 6 and finally with a port 30.

Referring again to FIG. 1, an electromagnetic or solenoid valve 15 is mounted on the housing member 7 to open and close the fuel passage 16 formed in the housing member 7.

Pressure regulators (not shown) are provided to assure that the pressure $P_1$ of the fuel fed through the fuel passage 16 into the pump is higher than the pressure $P_2$ of the fuel fed through the passage 23 into the pump.

The shaft 1 is fixedly secured to a pulser 20. A speed sensor 21 mounted on the housing member 7 to detect the number of revolution of the pulser 20.

Referring to FIG. 4, the fuel injection pump described has fuel suction period $\theta_2$ and fuel discharge period $\theta_1$ caused by a clockwise rotation of the shaft 1. The pump is designed for use with a four cylinder engine. For this reason, the inner peripheral surface of the roler ring 4 has four circumferentially equally spaced cams respectively corresponding to the engine cylinders.

The operation of the pump will be described hereinunder.

With reference to FIG. 1, the fuel is supplied from a fuel tank (not shown) through two fuel circuits (not shown) into the pump. One of the circuits includes a first pressure regulator (not shown) and is connected to the fuel passage 16, whereas the other circuit includes a second pressure regulator (not shown) and is connected to the passage 23. In a suction stroke of the pump, the fuel from the first circuit flows through the passage 16, the solenoid valve 15, the passage 14, the passage 19 and into the second pressure chamber 11. The fuel from the second circuit flows through the passage 23, the passage 22, the passage 41, the passage 40 and into the first pressure chamber 10. Because the pressure of the fuel fed through the passage 16 is higher than the pressure of the fuel fed through the passage 23, the pressure in the second pressure chamber 11 is higher than the pressure in the first pressure chamber 10, so that the injection plunger 9 is moved leftward as viewed in FIG. 1 with a resultant increase in the quantity of the fuel in the second pressure chamber 11.

In a delivery or discharge stroke of the injection plunger 9, the rotation of the shaft 1 moves the passage 19 in the shaft 1 out of communication with the passage 14 in the bushing and also moves the passage 40 in the shaft 1 out of communication with the passage 41 in the third housing 8, as shown in FIG. 2. As will be also seen in FIG. 2, the passage 14 is now communicated with the passage 13 in the shaft 1. As will be also seen in FIG. 3, the passage 18 in the shaft 1 is communicated with the passage 24 in the third housing 8. The pumping plungers 5 are moved a pumping stroke toward each other to cause a pressure rise in the first pressure chamber 10, so that the injection plunger 9 is moved rightwards as viewed in FIG. 3 to raise the pressure in the second pressure chamber 11. Accordingly, the fuel in the second pressure chamber 11 is forced therefrom through the passage 17, passage 18, passage 24, passage 25, suction-back valve 26 into the delivery port 27 from which the fuel flows through the delivery conduit (not shown) to an injection nozzle (not shown) and is injected therefrom into an associated engine cylinder. In the final stage of this injection stroke, the spill hole 34 in the shaft 1 is communicated with the passage 33 in the third housing 8 just before or when the injection plunger 9 comes into contact with the plug 12, whereby the pressure in the first pressure chamber 10 is lowered to stop the injection.

As will be seen from the above description, the quantity of the fuel injected one time from the second pressure chamber 11 is determined by the injection stroke of the injection plunger 9 and thus is equal to the volume of the second pressure chamber 11 at the moment when the injection plunger 9 starts its injection stroke. This initial volume of the second pressure chamber 11 is equal to the quantity of the fuel fed each time from the above-mentioned first fuel circuit through the passage 16, solenoid valve 15, passages 14 and 19 into the second pressure chamber 11. Accordingly, the quantity of fuel to be injected each time can be controlled by controlling the fuel supply from the first fuel circuit into the second pressure chamber 11.

The quantity of fuel to be injected is controlled in the manner to be described hereunder.

Referring to FIG. 1, the fuel supply into the second pressure chamber 11 in the suction stroke of the pumping plungers 5 is effected through the solenoid valve 15. The amount of the fuel to be fed into the second pressure chamber 11 can be controlled by controlling the valve-open period of the solenoid valve 15.

Figure 5:
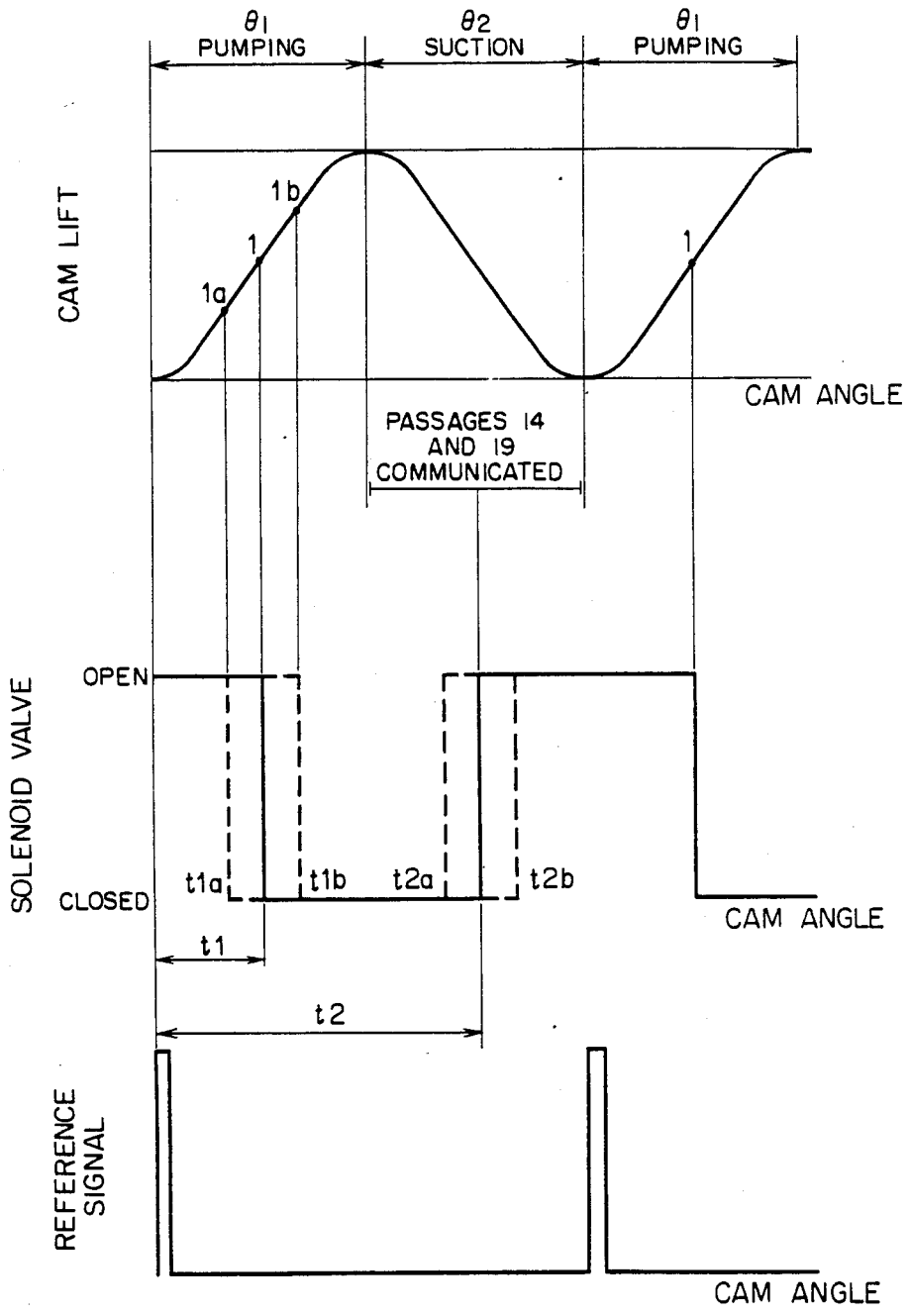

With reference to FIG. 5, reference signals shown are formed by outputs from a reference position sensor (not shown) which detects either the positions of pistons or cams of an associated engine or the positions of the cams of the injection pump. Time period $t_2$ is computed by a computer (not shown). As a result of the computation, the computer applies a valve-open signal to the solenoid valve 15. The fuel supply to the second pressure chamber 11 is effected during a time period from the moment when the solenoid valve 15 is opened to the moment when the communication between the passages 14 and 19 is interrupted by the rotation of the shaft 1.

If the valve-open timing of the solenoid valve 15 is advanced to a time point t2*a*, the duration of the fuel supply to the second pressure chamber 11 is increased with a resultant increase in the quantity of fuel injected. To the contrary, if the valve-open timing of the solenoid valve 15 is retarded to a time point t2*b*, the duration of the fuel supply to the second pressure chamber 11 is decreased with a resultant decrease in the quantity of fuel injected.

As will be seen from the foregoing description, the valve-open timing of the solenoid valve 15 is controlled to controll the duration of the fuel supply to the second pressure chamber 11 and thus to control the quantity of fuel to be injected.

The fuel injection timing control will be controlled in the manner to be described hereunder.

As shown in FIG. 2, when the solenoid valve 15 is in its open position in the pumping strokes of the pumping plungers 5, the fuel in the first pressure chamber 10 is forced out of the first pressure chamber 10 through the passages 13 and 14, the solenoid valve 15 and the passage 16. Thereafter, when the solenoid valve 15 is closed when the pumping movements of the pumping plungers 5 reach a cam lift position 1 in FIG. 5, the pressure in the first pressure chamber 10 begins to rise to move the injection plunger 9 rightwards as viewed in FIG. 1. The rightward movement of the injection plunger 9 causes the fuel in the second pressure chamber 11 to be forced out of the second pressure chamber 11 through the passages 17, 18, 24 and 25, the sucking-back valve 27 and delivery port 27.

By advancing the valve-closing timing of the solenoid valve 15 to a time point t1*a* as shown in FIG. 5, the timing of the rightward movement of the injection plunger 9 is advanced to advance the fuel injection timing. To the contrary, the valve-closing timing of the solenoid valve 15 can be retarded to t1*b* as shown in FIG. 5 to retard the timing of the rightward movement of the injection plunger 9 with a resultant retardation of the fuel injection timing.

As such, the fuel injection timing can be controlled by controlling the valve-closing timing of the solenoid valve 15 in the pumping strokes of the pumping plungers 5. The valve-closing timing of the solenoid valve 15 is determined by the computer (not shown) which computes a time period t1 from a reference signal (FIG. 5) and, on the basis of the result of the computation, emits a valve-closing signal to the solenoid valve 15.

A second embodiment of the present invention will be described with reference to FIGS. 6 to 10 in which the parts and members of the second embodiment the same as or similar to those of the first embodiment are designated by the same reference numerals. The following description will be focused mainly to the difference of the second embodiment from the first embodiment.

A shaft 1 is formed therein with generally radial passages 213 of a number the same as the number of an associated internal combustion engine. The passages 213 are communicated with a first pressure chamber 10 in the shaft 1 and are successively brought into communication with a radial passage 41 formed in a third housing 8 when the pump is in its suction stroke.

The shaft 1 is also formed therein with radial passages 217 of the number the same as the number of the associated engine, the passages 217 being communicated with a second pressure chamber 11 in the shaft 1. When the pump is in its suction stroke, i.e., when pumping plungers 5 are moved radially outwardly, one of the passages 217 is communicated with a radial passage 242 formed in a third housing 8.

Radial passages 18 of the same number as the engine cylinders are formed in the shaft 1 and are adapted to be successively brought into communication with a passage 24 in the third housing 8 as the shaft 1 is rotated. When one of the passages 18 is in communication with the passage 24, the pump is in its discharge stroke, i.e., when the pumping plungers 5 are being moved radially inwardly toward each other to reduce the volume of a compression chamber 100 defined therebetween. The radial passage 24 is always communicated with a passage 25 and thus with a delivery port 27, as in the first embodiment of the invention.

Spill holes 34 are formed in the shaft 1 and so positioned as to be communicated with the first pressure chamber 10 just before or when an injection plunger 9 comes into contact with a plug 12 in the bore 1*a*. One of the spill holes 34 is communicated with a passage 33 in the third housing 8, a passage 32 in a housing member 7, a chamber 29 therein, a passage 31 and a port 30, as in the first embodiment.

Figure 9:
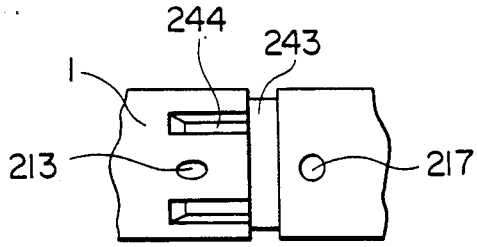

As will be seen in FIG. 9, an annular groove 243 is formed in the outer peripheral surface of the shaft 1. Axial grooves 244 of a number the same as that of the engine cylinders are formed in the outer peripheral surface of the shaft 1 and are communicated at their one ends with the annular groove 243. The annular groove 243 is always communicated with a radial passage 245 (FIG. 6) formed in the third housing 8. One of the axial grooves 244 is communicated with the passage 41 in the third housing 8 when the pumping plungers 5 are in their pumping strokes (see FIG. 7).

The third housing 8 is further formed therein with a metering chamber 247 communicated with the passage 41. A metering shuttle 246 is slidably disposed in the metering chamber 247 and has a radially inner end face directed toward the passage 41. The metering shuttle 246 is radially inwardly biased by a spring 248 received in a spring chamber 249 which is formed in the housing member 7 and communicated with the passage 23.

A solenoid valve 15 is mounted on the housing member 7 as in the first embodiment of the invention and is adapted to control the timing of fuel supply from a passage 16 into the second pressure chamber 11 and the metering chamber 247. For this purpose, the solenoid valve 15 is communicated with the passages 242 and 245 in the third housing 8.

The operation of the second embodiment of the invention will be described hereunder.

Figure 6:
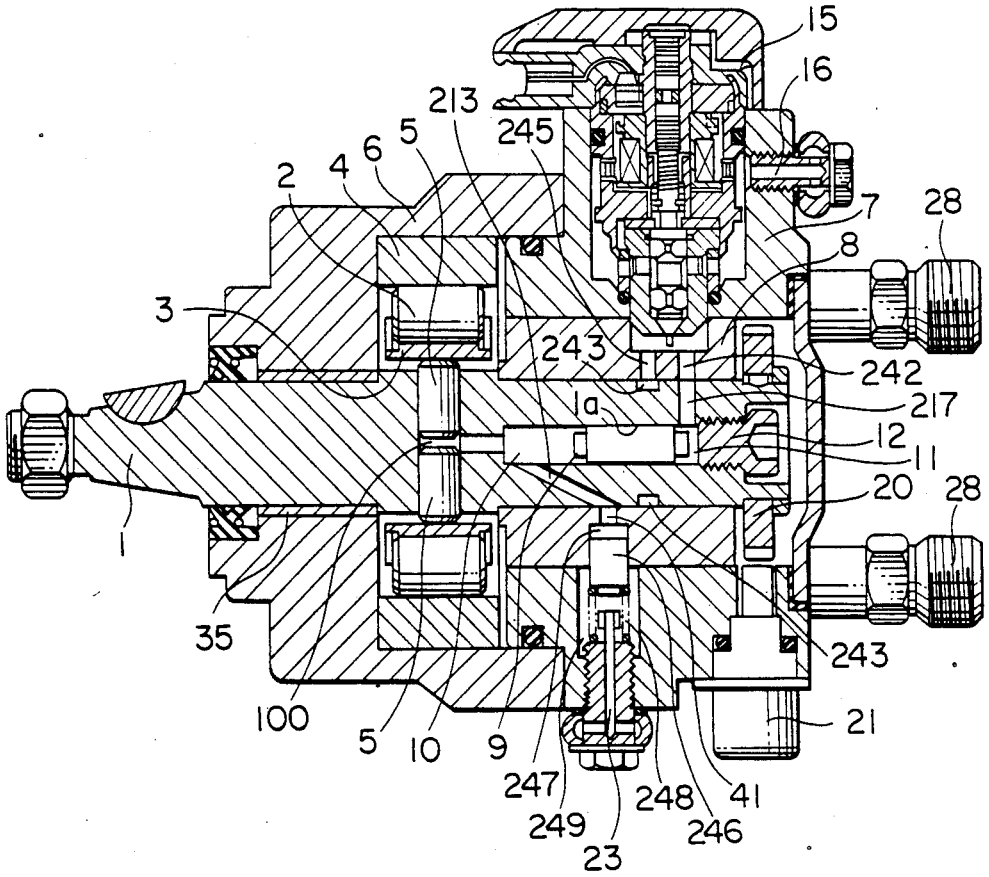

Referring to FIG. 6, in the suction strokes of the pumping plungers 5, the passage 217 is communicated with the passage 242 and the passage 23 is communicated with the passage 41. The fuel is supplied from a fuel tank (not shown) through the passage 16, the solenoid valve 15, the passge 242 into the second pressure chamber 11. The metering chamber 247 is also supplied with fuel in a manner to be described later. The fuel in the metering chamber is forced therefrom by the force of the spring 248 through the passage 41 and passage 213 into the first pressure chamber 10. The injection plunger 9 is moved leftwards in dependence on the quantity of fuel fed into the second pressure chamber 11. The pumping plungers 5 are radially outwardly moved away from each other in dependence on the quantities of fuel fed into the second and first pressure chambers 11 and 10.

Figure 8:
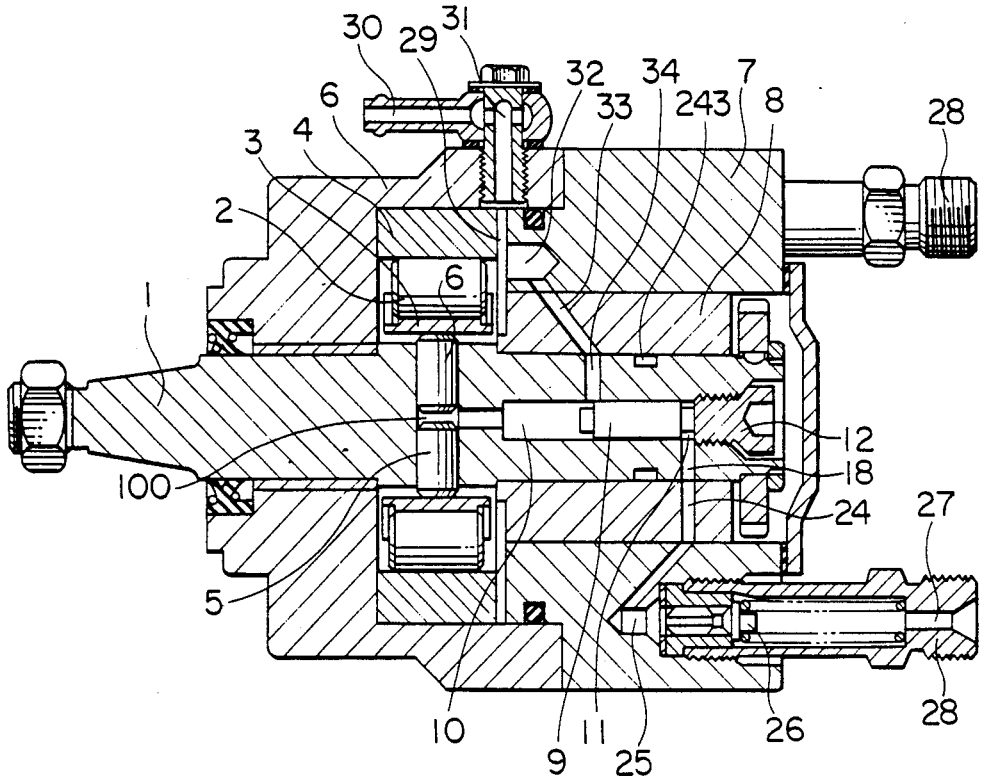

In the pumping strokes of the pumping plungers 5, the rotation of the shaft 1 moves the passages 217 and 213 out of communication with the passages 242 and 41, respectively, so that the pressure produced by the pumping strokes of the pumping plungers 5 is not applied to the solenoid valve 15. The passages 18 and 24 are communicated and, simultaneously, the spill hole 34 is communicated with the passage 33, as shown in FIG. 8. A further rotation of the shaft 1 moves the cam surfaces of the roller ring 4 into contact with the rollers 2 so that the roller ring 4 begins to radially inwardly move the pumping plungers 5. Thus, the pressure in the first pressure chamber 10 rises to move the injection plunger 9 rightwards with a resultant increase in the pressure in the second pressure chamber 11. As a consequence, the fuel in the second pressure chamber 11 is forced therefrom through the passages 18, 24 and 25, sucking-back valve 26 into the delivery port 28 from which the fuel flows to an associated injector (not shown) into an associated combustion chamber (not shown) of an internal combustion engine. Just before or when the injection plunger 9 comes into contact with the plug 12, the spill hole 34 is communicated with the passage 33, so that the pressure in the first pressure chamber 10 is lowered to finish the injection.

As will be seen from the above description, the fuel in the second pressure chamber 11 is injected by the injection stroke of the injection plunger 9 which is caused by the pumping strokes of the pumping plungers 5. The amount of the fuel to be injected can be controlled by controlling the volume of the second pressure chamber 11, i.e. the amount of the fuel fed into the second pressure chamber 11 through the solenoid valve 15, the passage 242 and the passage 217.

The fuel injection timing is determined by the time when the rollers 2 are brought into contact with the cam surfaces of the roller ring 4. This time is determined by the radial positions of the pumping plungers 5 which in turn are determined by the volumes of the first and second pressure chambers 10 and 11 at the moment when the pumping strokes of the pumping plungers 5 are commenced. Accordingly, the fuel injection timing can be controlled by controlling the amount of fuel fed into the first pressure chamber 10, or in other words, the amount of fuel fed into the metering chamber 247.

The amount of fuel to be injected each time can be controlled in the manner to be described hereunder.

The amount of fuel injected is dependent on the amount of fuel fed into the second pressure chamber 11, as descirbed above. The latter amount of fuel can be controlled by controlling the time period while the solenoid valve 15 is kept open to allow the fuel to flow from the passage 16 into the second pressure chamber 11.

Figure 10:
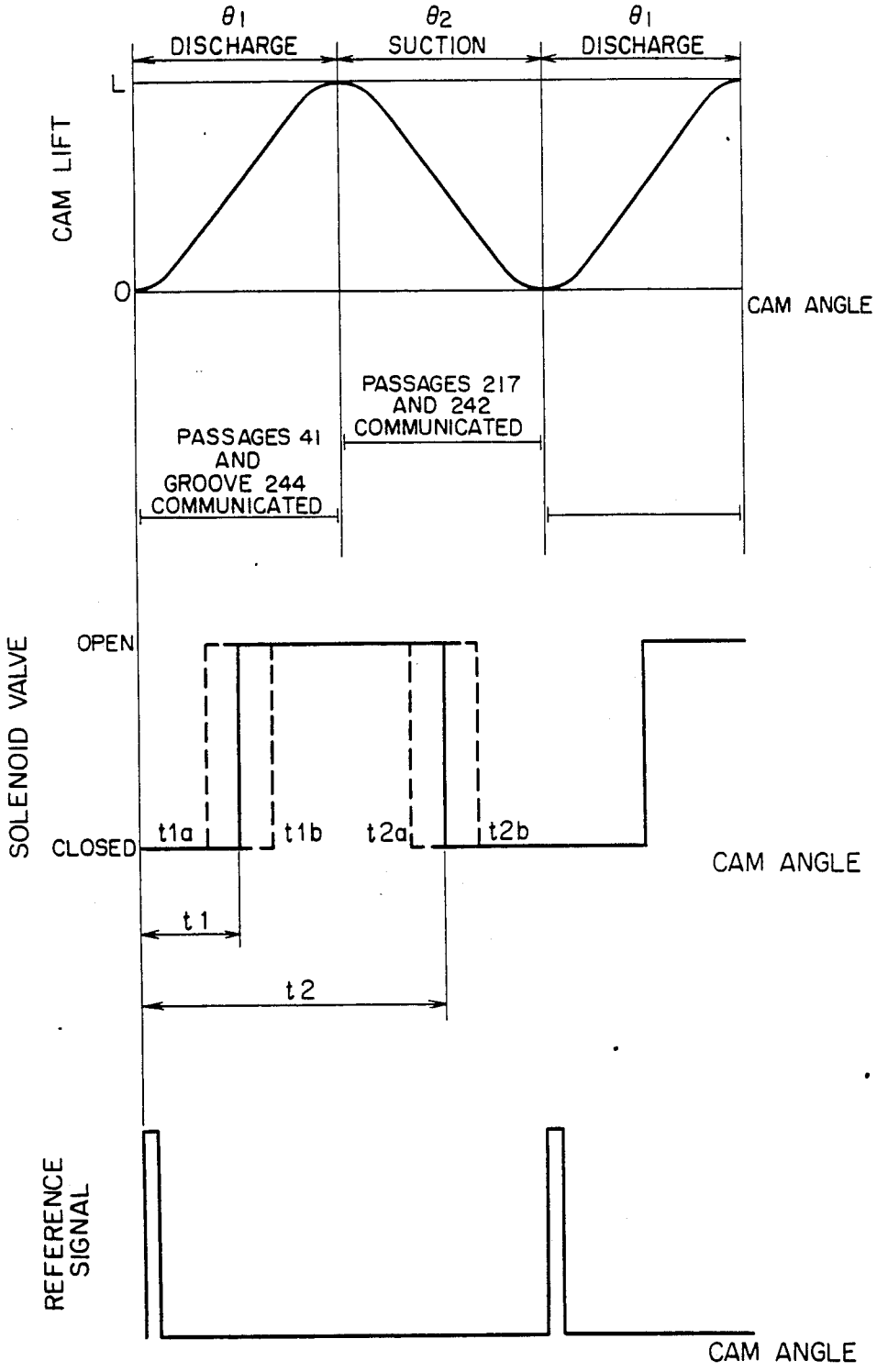

Referring to FIG. 10, a reference signal is formed by an output of a reference position sensor (not shown) operative to detect either the positions of the pistons or cams of an associated internal combustion engine or the positions of the cams of the injection pump. A time period t2 from the reference signal is computed by a computer (not shown). On the basis of the computation, a valve-open signal is applied to the solenoid valve 15. The fuel supply to the second pressure chamber 11 is effected during the period from the moment when the passages 217 and 242 are communicated to the moment when the solenoid valve 15 is closed.

If the valve-closing timing of the solenoid valve 15 is advanced to a point t2*a*, the duration of the fuel supply into the second pressure chamber 11 is shortened with a resultant decrease in the amount of fuel to be injected. To the contrary, if the valve-closing timing of the solenoid valve 15 is retarded to a point t2*b*, the duration of the fuel supply into the second pressure chamber 11 is extended or increased with a resultant increase in the amount of fuel injected. As such, the amount of fuel to be injected can be controlled by controlling the valve-closing timing of the solenoid valve 15.

The fuel injection timing can be controlled in the manner to be described hereunder.

Figure 7:
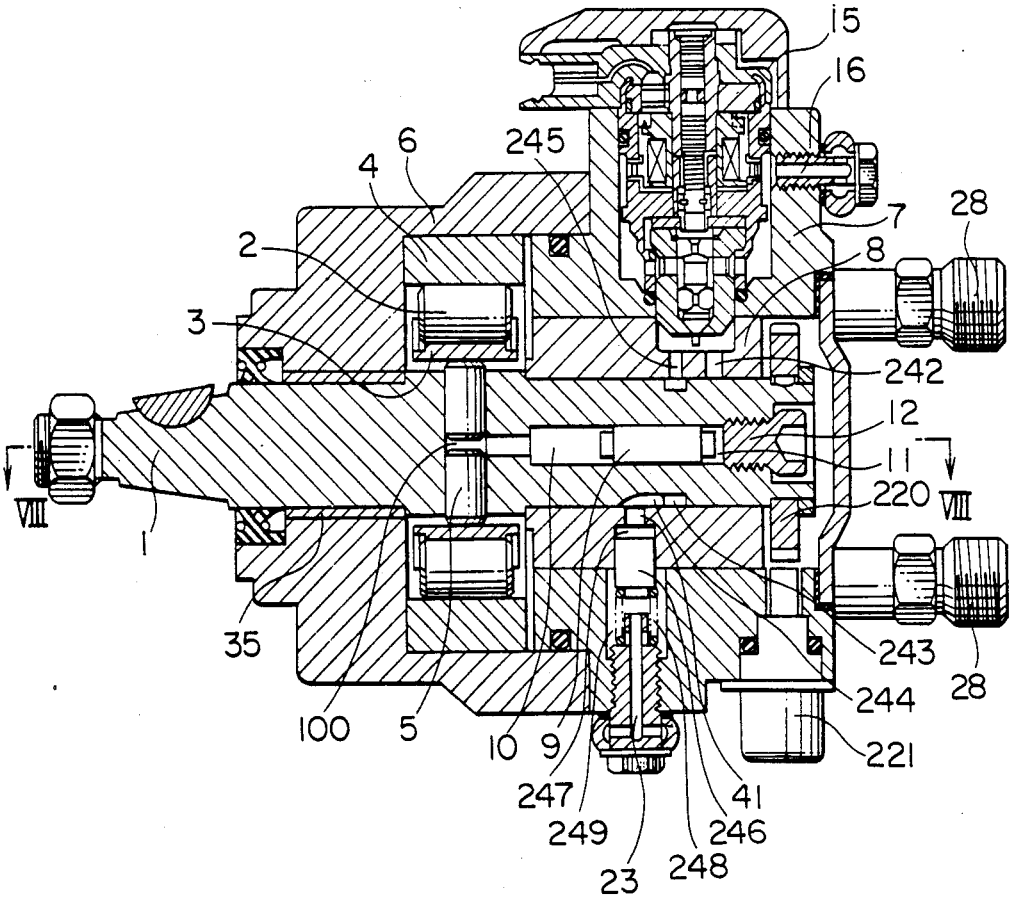

In the pumping strokes of the pumping plungers 5, the metering chamber 247 is communicated with the solenoid valve 15 in the passage 16 through the passage 41 in the third housing 8, the axial grooves 244 and annular groove 243 in the shaft 1 and the passage 245 in the third housing 8, as will be seen in FIG. 7. In the pumping strokes of the pumping plungers 5, therefore, the quantity of fuel to be supplied into the metering chamber 247 can be controlled by controlling the time period while the solenoid valve 15 is kept open in these strokes.

Referring to FIG. 10, time period t1 from a reference signal is computed by a computer (not shown) to open the solenoid valve 15. The fuel supply to the metering chamber 247 lasts from the moment when the solenoid valve 15 is opened to a moment when the communication between the passages 41 and the grooves 244 is interrupted. The spring 248 has a spring force which is so weak as not to interfer with the fuel supply into the metering chamber 247.

The valve-opening timing of the solenoid valve 15 can be advanced to time point t1*a* to increase the length of the duration of the fuel supply into the metering chamber 247 with a resultant increase in the amount of fuel supplied thereinto. This will mean that the amount of fuel supplied into the first pressure chamber 10 in succeeding suction strokes of the pumping plungers 5 is increased to increase the radially outward displacements of the pumping plungers 5, with a resultant advancement of the fuel injection timing.

On the contrary, the valve-opening timing of the solenoid valve 15 can be retarded to time point t1*b* to decrease the fuel supply into the metering chamber 247 for thereby retarding the fuel injection timing.

As will be seen from the above description, the fuel injection timing can be controlled by controling the valve-opening timing of the solenoid valve 15.

Figure 11:
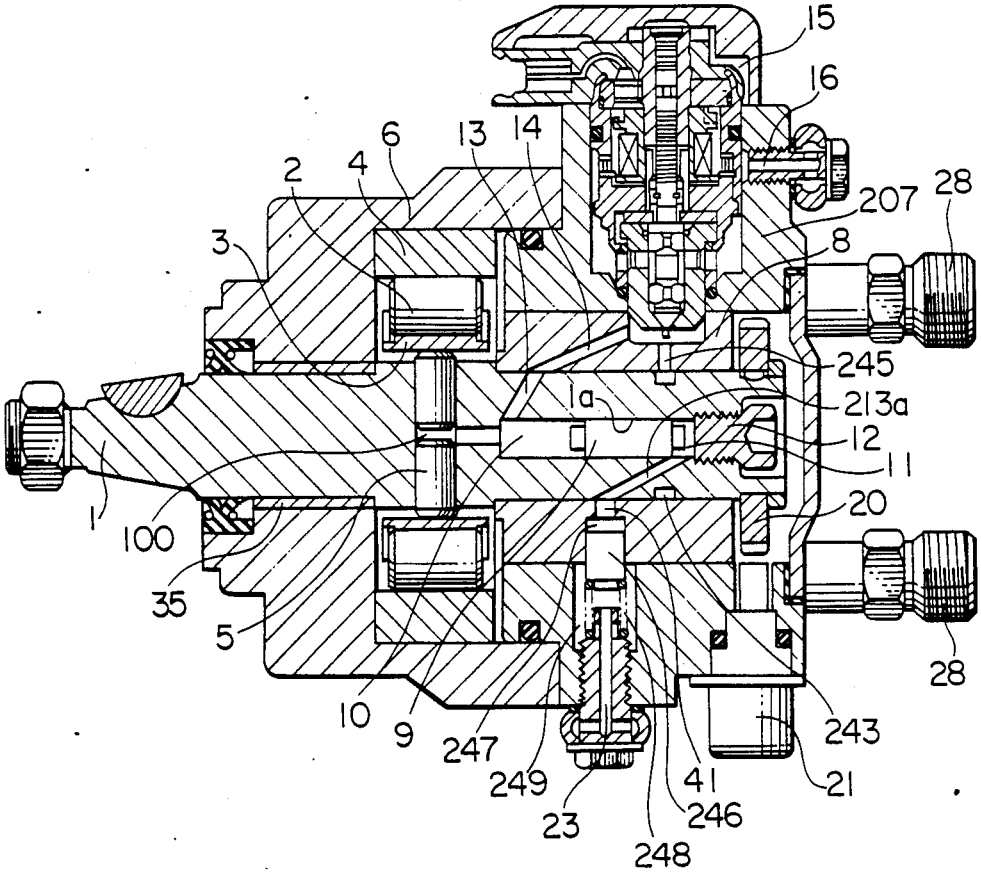
Figure 12:
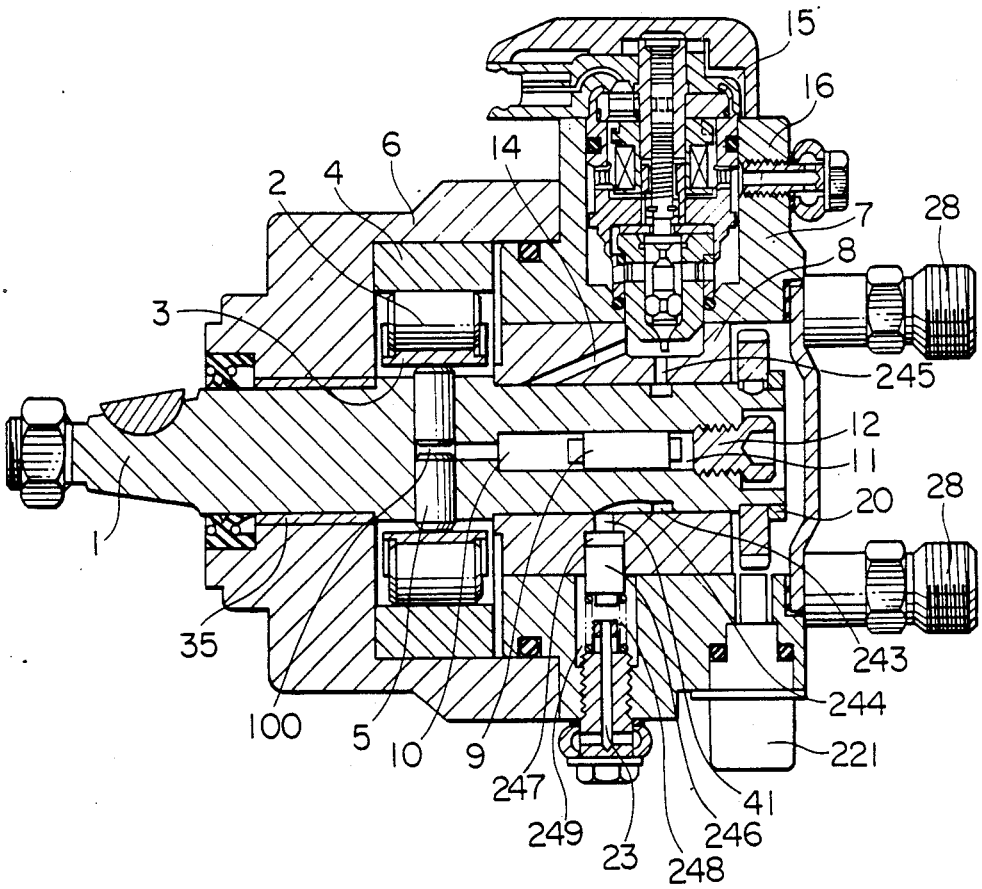
Figure 13:
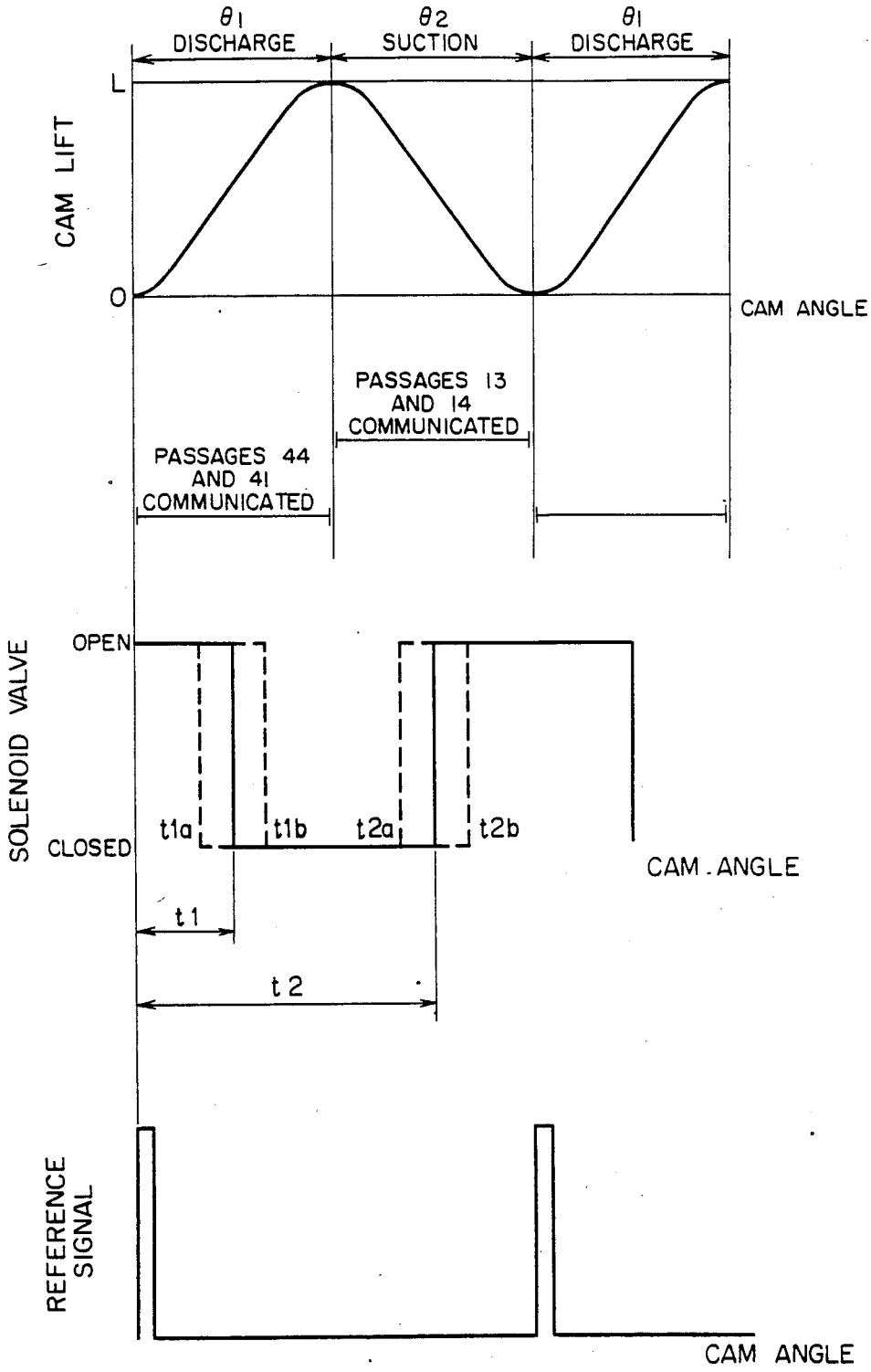

FIGS. 11–13 illustrates a third embodiment of the invention which is different from the second embodiment in that, in the third embodiment, the fuel supply into the second pressure chamber 11 is effected by means of the metering shuttle 246 and the first pressure chamber 10 is supplied with the fuel directly from the solenoid valve 15. For this purpose, the third housing 8 is formed therein with a passage 14 for communicating the valve 15 with passages 13 in the shaft 1 as in the first embodiment. The shaft 1 is formed therein with passages 213*a* for communicating the passage 41 in the bushing with the second pressure chamber 11. In this embodiment of the invention, the quantity of fuel to be injected can be controlled by controlling the valve-opening timing of the solenoid valve 15 and the fuel injection timing can be controlled by controling the valve-closing timing of the solenoid valve 15.

In the second and third embodiments of the invention, it has been described that the solenoid valve 15 is opened in the discharge stroke of the pump and is closed in the suction stroke of the pump. However, the quantity of fuel to be injected and the fuel injection timing can alternatively be controlled by closing the solenoid valve in the discharge stroke of the pump and opening the valve in the suction stroke of the pump, respectively.

The operation characteristics are illustrated in FIG. 13.

The amount of fuel to be injected in the case of the second embodiment as modified can be controlled in a manner to be described hereunder.

In the suction stroke of the pump, if the solenoid valve 15 is opened at a time point t2 from a reference signal, the fuel supply to the second pressure chamber 11 lasts from the moment when the valve is opened to the moment when the communication between the passages 242 and 217 is interrupted. If the valve-opening timing of the solenoid valve 15 is advanced to a time point t2*a*, the duration of the fuel supply to the second pressure chamber 11 is increased with a resultant increase in the quantity of fuel supplied into the second pressure chamber 11 and thus in the quantity of fuel to be injected. To the contrary, if the valve-opening timing of the solenoid valve 15 is retarded to a time point t2*b*, the duration of the fuel supply into the chamber 11 is decreased with a resultant decrease in the quantity of fuel to be injected.

The fuel injection timing can be controlled as follows:

If the solenoid valve 15 is closed at a time point t1 from a reference signal in a discharge stroke of the pump, the fuel supply into the metering chamber 247 lasts from the moment when the passages 244 and 41 are communicated to the moment when the solenoid valve 15 is closed. If the valve-closing timing of the solenoid valve 15 is advanced to a time point t1*a* to decrease the duration of the fuel supply into the metering chamber 247, the quantity of fuel supplied into the chamber 247 is decreased with a resultant retardation of the fuel injection timing. To the contrary, if the valve-closing timing is retarded to a time point t1*b*, the duration of the fuel supply into the metering chamber 247 is increased with a resultant advancement of the fuel injection timing.

It will be apparent to those in the art that the control of the amount of fuel to be injected and the fuel injection timing in respect of the third embodiment as modified above can also be similarly effected.

In the illustrated embodiments of the invention, the solenoid valve 15 is of seat type which, however, may alternatively be of spool valve type. In addition, the inner cam type fuel compression mechanism employed in the described embodiments may alternatively be either a face cam type or an outer cam type.

What is claimed is:

1. A fuel injection pump for an internal combustion engine comprising:

a housing having a cylindrical inner surface;

a shaft having a portion disposed in rotatably sliding engagement with said cylindrical inner surface and having a first axial bore and a second radial bore therein:

at least one pumping plunger slidably disposed in said second radial bore to cooperate therewith to define a compression chamber, said pumping plunger being adapted to be moved in said second radial bore to vary the volume of said compression chamber;

an injection plunger slidably disposed in said first axial bore to cooperate therewith to define first and second pressure chambers separated from each other by said injection plunger, said first and second pressure chambers having volumes variable as said injection plunger is slidably moved in said first axial bore, said first pressure chamber being always communicated with said compression chamber;

first passage means formed in said housing and having an outer end adapted to be connected to a first pressure source under a first predetermined fuel pressure and an inner end open in said cylindrical housing inner surface;

second passage means formed in said housing and having an outer end adapted to be connected to a second fuel pressure source under a second predetermined pressure lower than said first predetermined pressure, said second passage means having an inner end open in said cylindrical housing inner surface;

discharge passage means formed in said housing and having an outer end adapted to be connected to a fuel delivery port and an inner end open in said cylindrical housing inner surface;

at least one first suction fuel passage formed in said shaft and having an inner end always communicated with said second pressure chamber and an outer end adapted to be cyclically brought into communication with said inner end of said first passage means during rotation of said shaft, said first suction fuel passage being communicated with said first passage means in a suction stroke of said pump:

at least one second suction fuel passage formed in said shaft and having an inner end always communicated with said first pressure chamber and an outer end adapted to be cyclically brought into communication with said inner end of said second passage means during rotation of said shaft, said second suction fuel passage being communicated with said second passage means in the suction stroke of said pump;

at least one control passage formed in said shaft and having an inner end always communicated with said first pressure chamber, said control passage having an outer end adapted to be cyclically brought into communication with said inner end of said first passage means during rotation of said shaft, said control passage being communicated with said first passage means in a discharge stroke of said pump to permit the fuel in said first pressure chamber to be forced out therefrom by said pumping plunger into said first passage means:

at least one discharge fuel passage formed in said shaft having an inner end always communicated with said second pressure chamber and an outer end adapted to be cyclically brought into communication with said inner end of said third passage means during rotation of said shaft, said discharge fuel passage being communicated with said third passage means in the discharge stroke of said pump; and a single valve means disposed in said first passage means and having two operative positions, said valve means being opened in each suction stroke of said pump to permit the fuel to flow through said first passage means and through said first suction fuel passage into said second pressure chamber, said valve means being closed in a succeeding discharge stroke of said pump to block said first passage means thereby preventing the fuel in said first pressure chamber from being forced out of said first pressure chamber through said first passage means toward said first fuel pressure source whereby the fuel in said first pressure chamber forces said injection plunger toward said second pressure chamber to cause the fuel in said second pressure chamber to be discharged therefrom through said discharge fuel passage, through said third passage means and through said fuel delivery port and thus injected into an associated internal combustion engine, the valve open timing determining the quantity of fuel to be injected in each discharge stroke of the pump, the valve closing timing determining the fuel injection timing.

2. A fuel injection pump according to claim 1, further including fourth passage means formed in said housing, said shaft being further formed therein with a spill hole having an inner end communicated at the end of the fuel injection with said first pressure chamber and an outer end adapted to be brought into communication with said fourth passage means at a later part of each discharge stroke of said pump.

3. A fuel injection pump according to claim 1, wherein said valve means comprises a solenoid valve.

4. A fuel injection pump according to claim 3, further including means defining a metering chamber of a variable volume adapted to be communicated with said valve means in the discharge stroke of the pump and supplied with a quantity of fuel controlled by said valve means, said metering chamber being also adapted to be communicated with said first pressure chamber in the suction stroke of the pump so that said first pressure chamber is supplied with said quantity of fuel in the suction stroke.

5. A fuel injection pump according to claim 4, further including means operative to apply resilient pressure to said quantity of fuel in said metering chamber whereby said quantity of fuel is forced out of said metering chamber into said first pressure chamber in the suction stroke of the pump, said resilient pressure being lower than the pressure under which the fuel is fed into said metering chamber from said first passage means wherein said valve means comprises a solenoid valve.

6. A fuel injection pump according to claim 3, wherein said bore defining means comprises a shaft rotatable during operation of the pump, said shaft being formed therein with a substantially radial second bore, and at least one pumping plunger slidably received in said second bore to cooperate with said second bore to define said compression chamber, said pumping plunger being adapted to be reciprocated to cyclically vary the volume of said compression chamber, the first-said bore extending substantially axially in said shaft, said shaft being further formed therein with generally radial passages having inner ends open to one of said first and second pressure chambers, respectively, said generally radial passages being adapted to be communicated with said first passage means in successive suction strokes of the pump.

7. A fuel injection pump according to claim 3, further including means defining a metering chamber of a variable volume adapted to be communicated with said valve means in the discharge stroke of the pump and supplied with a quantity of fuel controlled by said valve means, said metering chamber being also adapted to be communicated with the other pressure chamber in the suction stroke of the pump so that said the other pressure chamber is supplied with said quantity of fuel in the suction stroke.

8. A fuel injection pump according to claim 7, further including means operative to apply resilient pressure to said quantity of fuel in said metering chamber whereby said quantity of fuel is forced out of said metering chamber into said the other pressure in the suction stroke of the pump, said resilient pressure being lower than the pressure under which the fuel is fed into said metering chamber from said first passage means.

* * * * *